US006487388B2

(12) United States Patent
Theodoulou et al.

(10) Patent No.: US 6,487,388 B2
(45) Date of Patent: Nov. 26, 2002

(54) SYSTEM AND METHOD FOR DUPLEX PRINTING

(75) Inventors: Sotos M. Theodoulou, Bramalea (CA); Robert A. Moore, Mashpee, MA (US); Wojciech Zalewski, South Easton, MA (US); Sarbjit Parhar, Mississauga (CA); Jeffrey P. Belbeck, Mississauga (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/768,910

(22) Filed: Jan. 24, 2001

(65) Prior Publication Data

US 2002/0098017 A1 Jul. 25, 2002

(51) Int. Cl.[7] ..... G03G 15/16
(52) U.S. Cl. ..... 399/307; 399/309

(58) Field of Search ..... 399/307–309

(56) References Cited

U.S. PATENT DOCUMENTS

| | | | | |
|---|---|---|---|---|
| 5,530,534 A | | 6/1996 | Dalal | |
| 5,550,624 A | * | 8/1996 | Wachtler | 399/309 |
| 5,629,761 A | | 5/1997 | Theodoulou | 399/307 |
| 5,797,077 A | * | 8/1998 | Samizo et al. | 399/309 |
| 5,893,018 A | * | 4/1999 | De Bock et al. | 399/307 X |
| 6,047,156 A | * | 4/2000 | De Bock et al. | 399/309 X |

* cited by examiner

*Primary Examiner*—William J. Royer
(74) *Attorney, Agent, or Firm*—Fay, Sharpe, Fagan, Minnich & McKee, LLP

(57) ABSTRACT

An image forming system having two simplex print engines is provided that transfers and fuses two images on either side of a substrate in a single nip. The two images can be formed simultaneously at the single nip.

19 Claims, 4 Drawing Sheets

SYSTEM AND METHOD FOR DUPLEX PRINTING

TECHNICAL FIELD

The present invention relates generally to printing in image forming systems, and specifically relates to duplex printing in such systems.

BACKGROUND OF THE INVENTION

Conventional image forming systems, such as toner imaging systems, where a latent charge image is developed with a pigmented toner, are widespread in the office and home. Once developed with the toner, the image is transferred to a receiving member to form a printed image on a substrate, such as a sheet of paper.

Many technologies exist for forming a latent charge image, including optical image projection onto a charged photoconductive belt or drum, charging a dielectric member with an electrostatic pin array or electron beam, and charge projection from an ionographic print cartridge or from a plasma generator. Once a latent image is formed, the latent image may be transferred to an intermediate member before development. Alternatively, the latent image may be developed on the same member as that on which it is formed, with different system architectures having evolved to address different process priorities, such as cost, speed, preferred type of toning system or intended receiving substrate. A liquid-carried toner or a dry powder toner may be used. The former raises environmental issues that involve solvent or carrier management, especially when printing on so-called plain, or bond, papers, while the latter raises concerns of dust control, especially as the toner particle size becomes finer.

In general, there are two methods of producing the final image on a substrate. First, according to a conventional heating method, the toned image, once transferred to a receiving member, is heated to dry or fix the image on the substrate during the final stage of printing. Heating of the toned image at an earlier stage, e.g., when the toner is applied as a dust or liquid suspension to the latent charge image, is, however, avoided. In addition, in the heating method, heating should also be avoided on or near any photoconductive elements. Even for charge deposition systems in which an electric charge is applied to a dielectric rather than photoconductive member, heat may impair the dielectric properties of some common image-holding materials.

Aside from the sensitivity of the components of the system to heat, one disadvantage associated with the heating method arises when trying to print in duplex mode where an image is formed on both sides of the substrate, which, for example, may be paper. In the cut-sheet environment, where the substrate is a cut sheet of paper, the paper is re-circulated in a printing machine to print on both sides. Unfortunately, recirculation increases the amount of time to print, and makes it more likely that paper jams can occur. In the web environment, where the substrate is an uncut roll of paper, printing in duplex mode is done by two printing stations, which can be separated by several meters. Such a method of printing on both sides of the substrate that involve two printing stations separated by such a distance can give rise to paper wrinkling, web breaks, problems registering the front page to the back page, and large "footprints."

The second method of producing the final image on a substrate is a transfusing method in which the toned image is simultaneously transferred to and fixed on the final member in a softened state. By controlling the temperature, the relative tackiness or the cohesion of the heated toner may be made to vary to achieve optimal transfer of the image between surfaces, and when transferring to a final recording sheet, to optimize "image fix" properties.

SUMMARY OF THE INVENTION

The transfusing method of the present invention possess several advantages over the conventional image transfer and fusing methods. For example, because in the former the image is transferred and fused to the substrate simultaneously, there is a savings in both space and equipment to form a completed image on the substrate. It is a significant aspect of the present invention that the image forming system is capable of duplex printing using the transfusing method.

An image forming system for duplex printing is provided which transfers and fuses the duplex images to both sides of a substrate at a single transfuse nip. Part of the image forming system has reflection or mirror-image symmetry about a line formed by the substrate. On each side of the line of symmetry there is a simplex transfuse engine arranged mechanically to transfuse an image to both sides of the substrate at a single nip.

In particular, an image forming system for printing on both sides of a substrate is provided. The system includes first and second transfer members forming a single transfuse nip therebetween. The system also includes a first imaging member for generating a first toner image that is received by the first transfer member; and a second imaging member for generating a second toner image that is received by the second transfer member. At the single transfuse nip, the first transfer member is suitable for transferring the first toner image to a first side of the substrate to form a first print, and the second transfer member is suitable for transferring the second toner image to a second side of the substrate to form a second print.

The first transfer member exerts a first force on the substrate to form the first print, and the second transfer member exerts a second force on the substrate to form the second print, such that the first force and the second force simultaneously oppose each other. The first print and the second print may be formed simultaneously on the substrate at the single transfuse nip. The first and second transfer members may each have a surface energy of between about 20 and about 40 dynes/cm, and a hardness of between about 50 and about 80 Shore A. Moreover, the toner may have a softening temperature $T_s$. The first imaging member and the first transfer member may each operate substantially isothermally at temperatures T1 and T2, respectively. Likewise, the second imaging member and the second transfer member may each operate substantially isothermally at temperatures T1 and T2, respectively, such that $T1<T_s<T2$.

The first transfer member may transfer the first toner image in a melted state to the first side of the substrate. Likewise, the second transfer member may transfer the second toner image in a melted state to the second side of the substrate, as the temperature of the first toner image and the second toner image decrease. The system may further include a preheat assembly for preheating the substrate to a temperature T3 prior to introduction to the transfuse nip, such that $T3<T2$.

An image forming system is also described herein that includes a first print engine for forming a first toner image, and a second print engine for forming a second toner image.

The system further includes a single transfuse nip formed between the first and second print engines wherein the first and second toner images are transferred to opposite sides of a substrate at the nip.

DETAILED DESCRIPTION OF THE INVENTION

An image forming system suitable for performing duplex web printing is provided herein that can transfer and fuse images to both sides of a print medium simultaneously in a single nip. Image forming systems include electrophotographic, electrostatic or electrostatographic, ionographic, and other types of image forming or reproducing systems that are adapted to capture and/or store image data associated with a particular object, such as a document. The system of the present invention is intended to be implemented in a variety of environments, such as in any of the foregoing types of image forming systems, and is not limited to the specific systems described below.

Figure 1:
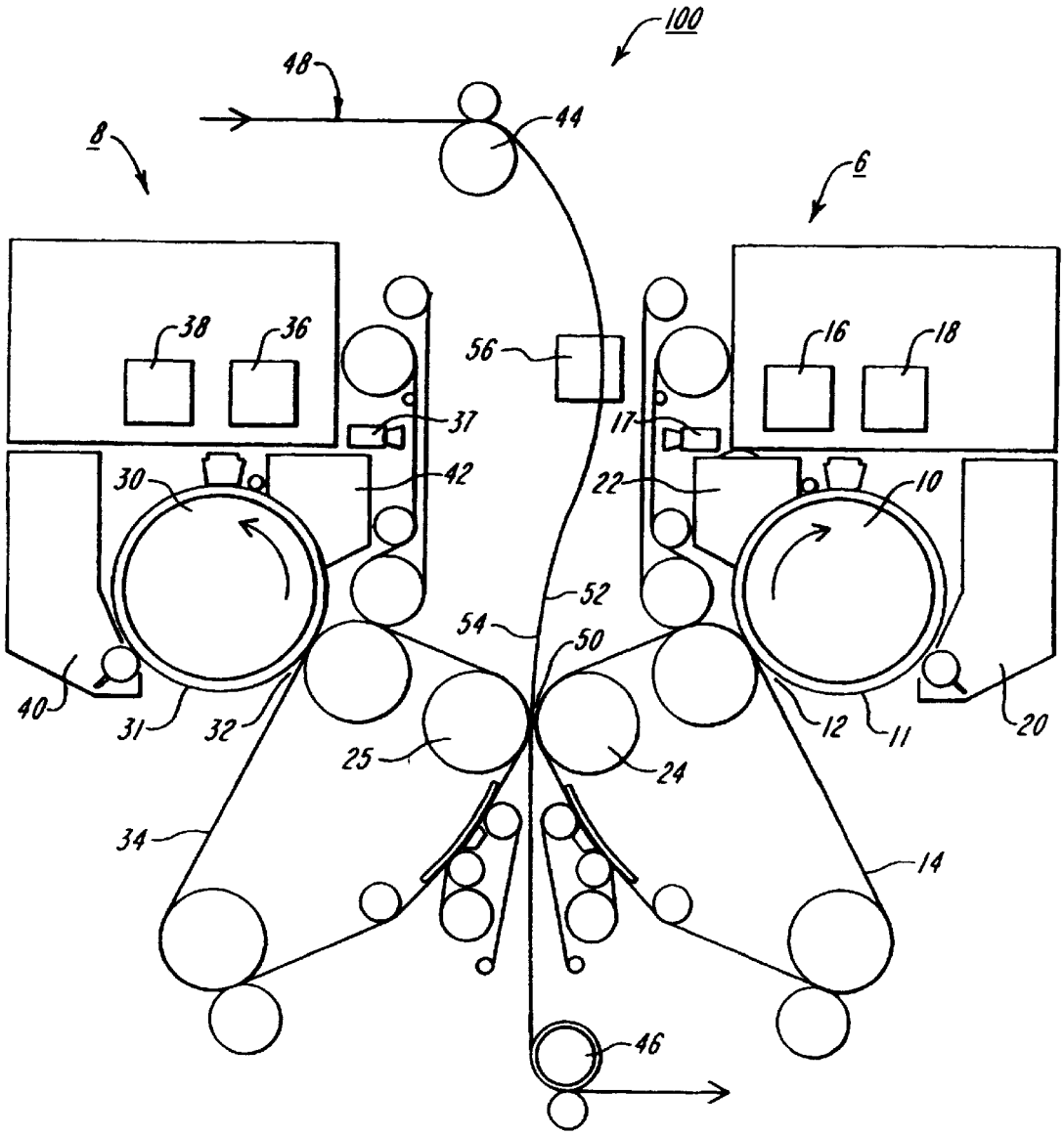
FIG. 1 is a schematic representation of an image forming system for performing monochrome duplex printing on a substrate according to the teachings of the present invention.

Referring to FIG. 1, an image forming system 100 suitable for performing duplex web printing is shown. The system 100 includes a first simplex print engine 6 and a second simplex print engine 8. The system further includes a back tension station 44 and a forward tension station 46. The print engines 6 and 8 may be used to form an image on either or both sides of a substrate 48, such as a paper web, at a single transfuse nip 50. The tension stations 44 and 46 guide the substrate through the print engines 6 and 8, while consistently keeping the substrate taught when passing therethrough.

The first simplex print engine 6 includes a first imaging member 10, such as an image drum, that forms a first transfer nip 12. The first imaging member 10 includes a first imaging member surface 11 from which a first toner image can be transferred to a first transfer member 14. The temperature of the surface 11, denoted by T1, is approximately 60–65° C. In one embodiment, the surface energy of the surface 11 is below about 20 dynes/cm and the surface energy of the first transfer member 14 is above about 20 dynes/cm.

The imaging member includes any suitable structure for supporting the latent image receiving member, and can include a drum, a curved imaging member, or a flexible dielectric belt, which moves along a predetermined path. The drum can also be an imaging member, such as a liquid crystal, phosphor screen, or similar display panel in which the latent charge image results in a visible image. The imaging member, or drum, typically includes on an exterior surface thereof, a material that lends itself to receiving the latent charge image, such as a dielectric layer. A number of organic and inorganic materials are suitable for the dielectric layer of the image receiving member. The suitable materials include glass enamel, flame or plasma sprayed high density aluminum oxide, electrochemically formed aluminum oxide, and plastic, including polyamides, nylons, and other tough thermoplastic or thermoset resins, among other materials. In one embodiment, the dielectric material of the image receiving member includes fluoropolymer, and in particular PFA teflon.

The first transfer member 14 can be a transfuse belt that includes an inner strength member (carcass), which gives the belt geometrical stability, and an outer coating of soft silicone rubber, which may be capable of dissipating static charge. In one embodiment of the present invention, the rubber coating has a thickness between about 0.5 and about 2.0 mm, and has a hardness between about 50 and about 60 Shore A. The transfuse belt is maintained at a temperature between about 130 and about 150° C., the temperature depending on the type of toner used and the overall system application.

The first simplex print engine 6 further includes a first erase station 16 and a first imaging center 18 that are electrically coupled to the first imaging member 10. The first erase station 16 includes a corona device (not shown) that is accurately registered in close proximity to a surface of the first imaging member 10. The first imaging center 18 may include a print head (not shown) that is accurately registered in close proximity to a surface of the first imaging member 10, and an array of electron guns (not shown). A first development station 20, containing toner powder, is coupled to the first imaging member 10. A first cleaning station 22 is also coupled to the first imaging member 10, and includes a scraper blade to scrape off excess toner and other contaminants from the first imaging member 10, and a vacuum system to remove scrapings and other loose matter. The first cleaning station 22 may also include a web cloth cleaner that presses lightly on the imaging member surface 11 and advances slowly in a direction opposite to that of the rotation of the imaging member 10 to remove contaminants. The web cloth may be stored on a supply roll and slowly taken up by a take-up roll after use.

A first calibration station 17 is coupled to the first imaging center and electronically controls the electrons leaving the first imaging center 18 based on data collected during a calibration cycle.

The second simplex print engine 8 includes a second imaging member 30, such as an image drum, that forms a second transfer nip 32. The second imaging member 30 includes a second imaging member surface 31 from which a second toner image can be transferred to a second transfer member 34. The temperature of the surface 31, denoted by T1, is approximately 60–65° C. In one embodiment, the surface energy of the surface 31 is below about 20 dynes/cm and the surface energy of the second transfer member 34 is above about 20 dynes/cm. The second transfer member 34 can be a transfuse belt that includes an inner strength member (carcass), which gives the belt geometrical stability, and an outer coating of soft silicone rubber, which may dissipate static charge. In one embodiment of the present invention, the rubber coating has a thickness between about 0.5 and about 2.0 mm, and has a hardness between about 50 and about 60 Shore A. The transfuse belt is maintained at a temperature between 130 and 150 Celsius, the temperature depending on the type of toner used and the overall system application.

The second simplex print engine 8 further includes a second erase station 36 and a second imaging center 38 that are electrically coupled to the second imaging member 30. The second erase station 36 includes a corona device (not shown) that is accurately registered in close proximity to a surface of the second imaging member 30. The second imaging center 38 includes a print head (not shown) that is accurately registered in close proximity to a surface of the second imaging member 30, and an array of electron guns (not shown). A second development station 40, containing toner powder, is coupled to the second imaging member 30. A second cleaning station 42 and a second calibration station 37 are analogs of the first cleaning station 22 and the first calibration station 17.

The first and second simplex print engines 6 and 8 form an image or print on either side of the substrate 48. For this purpose, the substrate 48 is delivered to a transfuse nip 50 formed by the first transfer member 14 and the second transfer member 34. The temperature of the first and second transfer members 14 and 34, denoted by T2, is approximately 130–150° C. At the transfuse nip 50, the first transfer member 14 is in contact with a first side 52 of the substrate 48 to form a first print (not shown) on the first side 52, and the second transfer member 34 is in contact with a second side 54 of the substrate 48 to form a second print (not shown on the second side 54. The print image is disposed on both sides of the substrate 48 at a single nip, the transfuse nip 50.

The first imaging member 10 and the second imaging member 30 have dielectric surfaces 11 and 31 for receiving an image. In one embodiment, the dielectric surfaces 11 and 31 possess an appropriate surface capacitance for imaging. The surfaces are disposed at selected temperature, denoted as temperature T1, and can be smooth, hard and of low free energy to accommodate powder toner transfer to the first and second transfer members 14 and 34, and to allow rigorous cleaning of residue and other contaminants without suffering appreciable loss of service life. The dielectric surfaces 11 and 31 can support the applied mechanical load at the transfer nips 12 and 32 and maintain uniform pressure distribution. An internal fin structure allows removal of heat from the first and second imaging members 10 and 30 and provides the means for accurately maintaining the temperature of the members 10 and 30 below the glass transition temperature of the toner used.

The first and second erase stations 16 and 36 produce positive and negative ions, which electrically neutralize the charge on the image receptor to a desired uniform potential. The first and second imaging centers 18 and 38 each include a print head having an array of electron guns for projecting pixels of image charge of the desired dot density (i.e., 600 dpi) onto the surfaces 11 and 31 of the imaging members 10 and 30. At the development stations 20 and 40, powder toner transfer is induced by the charge of the latent image. The cleaning stations 22 and 42 physically clean the surface of the imaging members 10 and 30 after the developed image is transferred to the first and second transfer members 14 and 34 before the next erase/imaging cycle commences.

The simultaneous transfuse nip 50 operates in conjunction with the back-tension station 44, the forward-tension station 46, and a preheat assembly 56. The transferred toner is transported by the first transfer member 14 from the first transfer nip 12 to the transfuse nip 50, and by the second transfer member 34 from the second transfer nip 32 to the transfuse nip 50. During this transfer, heat is diffused into the toner from the rubber body of the transfer members 14 and 34 rendering the toner softer and tackier. Extra heat may be applied to the toner and transfer members 14 and 34 during this transfer so as to precondition the toner for more efficient transfuse to the substrate 48.

The substrate 48 is delivered to the transfuse nip 50 at an elevated temperature attained by use of the preheat assembly 56. A selected amount of back-tension is provided by station 44 to the substrate to facilitate proper tracking through the preheat assembly 56 and the transfuse nip 50. Likewise, tension station 46 applies tension to the substrate 48 after passing through the nip 50.

The soft tacky toner that forms a first toner image on the first transfer member 14, and a second toner image on the second transfer member 34, is applied to the preheated paper at the transfuse nip 50. The second transfer member 34 exerts a first force on the first transfer member 14 for transferring the first toner image to the first side 52 of the substrate 48. Likewise, the first transfer member 14 exerts a second force on the second transfer member 34 for transferring the second toner image to the second side 54 of the substrate 48. The force exerted by the first transfer member 14 arises from a force supplied by a first pressure roll 24. Likewise, the force exerted by the second transfer member 34 arises from a force supplied by a second pressure roll 25. Under the influence of these forces, the toner flows and anchors itself onto the sides 52 and 54 of the substrate 48. According to one practice of the present invention, a first print and a second print are thereby formed simultaneously on the first side 52 and second side 54, respectively. Virtually 100% toner transfer occurs due to the difference in surface energies between the substrate 48 and transfer members 14 and 34, and to the difference in the effective contact areas on both sides of the toner, which favor transfer to paper, and the cohesive strength of the toner under the transfuse nip 50 conditions, which is sufficiently high so as not to allow "splitting" during separation. Total separation is further aided by the difference in velocities of the substrate and of the surfaces of the transfer members at the exit of the nip.

It should be understood that in other embodiments of the present invention, the first and second prints on the substrate 48 need not be formed simultaneously. Instead, it is possible for some time to elapse between the formation of the first print and the second print at the single transfuse nip 50, thereby staggering the first and second prints on the substrate 48.

The image forming system 100 shown in FIG. 1 is of the type where the imaging member first transfers the developed image onto a distinct transfer member, the device that directly transfers the developed image to the substrate, before the transfer member transfers the image to the substrate. The distinct transfer member can be a suitable drum, or belt, for example. In other embodiments, the imaging member, and the transfer member are coincident, so that the imaging member and transfer member functions as both a device to form an image thereon, and as a device to transfer the image onto the substrate.

Figure 2:
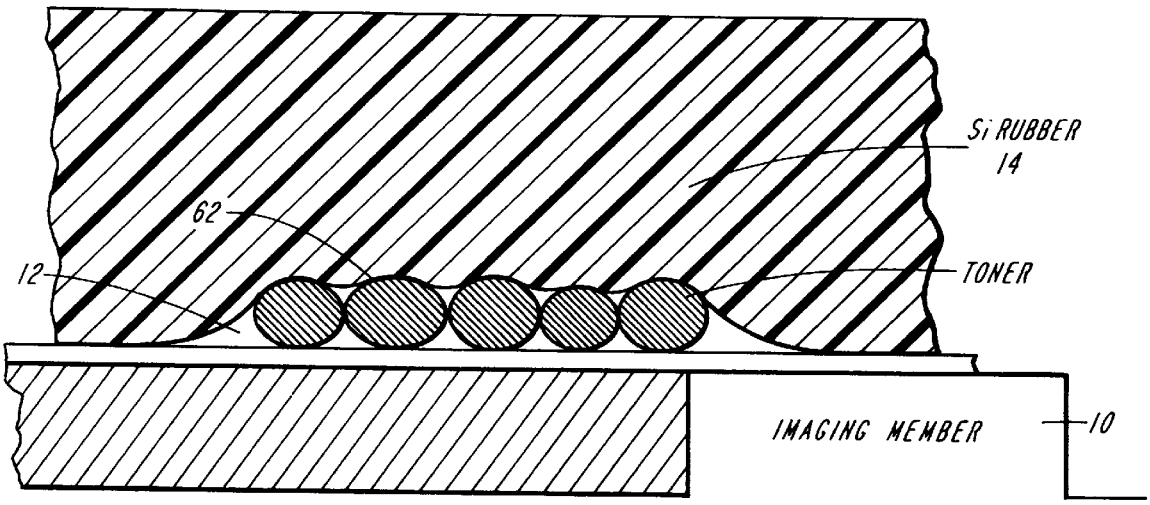
FIG. 2 is a schematic representation, in partial cross-sectional view, of the transfer of toner particles between an imaging member and a transfer member of the image forming system of the present invention.

Referring to FIG. 2, a schematic of toner particles 62 in the first transfer nip 12 is shown. Mechanical forces applied between the first imaging member 10 and the first transfer member 14 at the first transfer nip 12 induce rubber deformation which in turn provides a finite contact width (nip width). As the toner particles 62 of the developed image enter the nip 12, the soft rubber layer of the first transfer member 14 micro-conforms to the toner particles 62. Transiently, the toner particles 62 are in contact with the hot rubber surface of the first transfer member 14 on one side and the reasonably cool surface of the first imaging member 10 on the other. A thermal gradient is formed across the thickness of the toner particles 62 with one side being hot and tacky while the other side maintains a harder non-tacky surface. At the nip exit, the toner particles 62 follow the hot rubber of the first transfer member 14 on their tacky side and easily separate from the first imaging member 10 on their non-tacky side.

The toner particles 62, which may be primarily composed of a thermoplastic resin compounded with iron oxide and carbon black, and may contain blended waxes, have a mean particle size of ten to fifteen micrometers in diameter. By way of example, the Coates RP 1442 toner becomes tacky at a softening temperature, $T_s$, of 90–110° C., and fuses at about 105° C. The first imaging member surface 11 may be maintained at a relatively low temperature T1, below about 65° C., while the first transfer member 14, at a temperature of T2 approximately equal to 130–150° C., which allows the toner image to acquire viscoelastic characteristics.

It should be understood that a similar figure to that of FIG. 2 pertains at the second transfer nip where toner particles are likewise "sandwiched" between the second imaging member 30 and the second transfer member 34.

Figure 3:
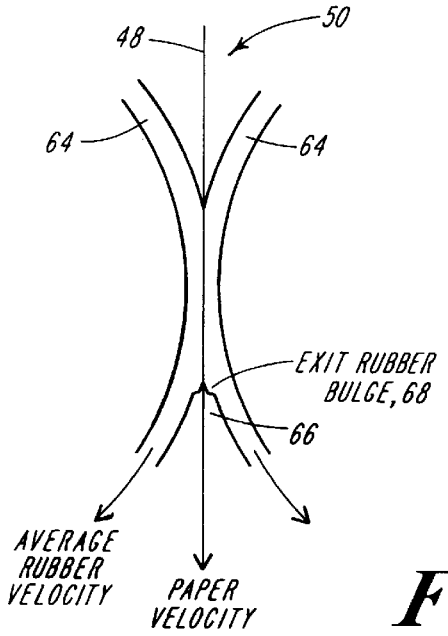
FIG. 3 is a schematic illustration of the forces applied to the substrate and the deformation of the transfer members at the transfer nip of the image forming system.

Referring to FIG. 3, a schematic diagram illustrating the stripping forces applied to the substrate 48 at the transfuse nip 50 is shown. Because of the rubber distortion in the transfuse nip 50 caused by the externally applied mechanical forces, the substrate 48 attains a velocity higher than the average velocity of the rubber 64 of the first and second transfer members 14 and 34. At the nip exit 66 this differential velocity tends to shear the fused image from the surface of the rubber 64 (self-stripping). In solid print areas, in the absence of supplemental release agents on the surface of the transfer members 14 and 34, the forces required to shear the image may exceed the buckling strength of the substrate 48, and may result in inadequate stripping. Small amounts of exit tension, provided by the forward tension station 46, tend to assist the self-stripping action. The higher exit paper tension promotes better stripping because the higher tension increases the differential velocity by adding traction creep to the existing distortion creep. The resulting traction creep results in a small rubber bulge 68 at the nip exit 66 which induces additional strip assist by introducing higher lateral departure speeds between the substrate 48 and the rubber 64.

There are several advantages of the systems and methods for duplex printing provided herein. First, because the duplex printing of the present invention is achieved at a single nip, instead of at two or more nips, the image forming system 100 has a smaller footprint than conventional image forming systems. Second, because the duplex printing is performed at a single nip instead of at two nips separated by an appreciable distance, the path that the substrate 48 travels is relatively short. With a shorter travel path, the substrate 48 has a lower probability of wrinkling or breaking. Third, because duplex printing can be performed simultaneously at a single nip, the time required to print is significantly shortened. Fourth, because each of the pressure rolls 24 and 25 of the transfer members 14 and 34 provide back support for each other, there is a reduction of hardware, and therefore cost, required for duplex printing compared to conventional methods where additional pressure rolls are required.

In operation, the first imaging member 10, shown in FIG. 1 as a drum, receives an image and carries it to the first transfer nip 12 formed between the first imaging member 10 and the first transfer member 14, shown as a belt in FIG. 1. At the nip 12, the developed toner image is transferred to the first transfer member 14, which then carries it to the transfuse nip 50 formed between the first and second transfer members 14 and 34. At the transfuse nip 50, the first transfer member 14 exerts a first force on the substrate 48 to form the first print, and the second transfer member 34 exerts a second force on the substrate 48 to form the second print. The first and second forces applied by the transfer members at the transfuse nip 50 simultaneously oppose each other. The first and second pressure rolls 24 and 25, which may be driven synchronously, allow the first and second transfer members 14 and 34 to exert the first and second forces. In one embodiment, the first print and the second print may thus be formed simultaneously. It should be understood that one or more of the rolls 24 and 25 may be an idler roll driven by contact with the opposing sheet, belt or drum.

Once the latent image is formed and developed on the first imaging member 10, using methods known to those of ordinary skill in the art (see, for example, U.S. Pat. Nos. 4,992,807 and 5,103,263 the contents of which are incorporated by reference), the resulting image is deposited on the first transfer member 14.

In accordance with the principles of the present invention, the first imaging member surface 11, and the first transfer member 14 are thermally controlled so that each is at a constant temperature T1 and T2, respectively, immediately before making contact at the transfer nip.

The first transfer member 14 carries the received and heated toner image to the transfuse nip 50, where it is transfused, or simultaneously transferred to and fused on the first side 52 of the substrate. It should be understood that the above description also applies to the image formed on the second imaging member 30, and second transfer member 34. The illustrated system 100 method thus allows a first and second print to be formed simultaneously on the first and second sides 52 and 54 of the substrate 48.

In order to ensure that the contact and wicking between the toner particles 62 and the substrate 48 at the transfuse nip 50 is relatively complete and is not disrupted by excessively fast cooling, both sides 42 and 54 of the substrate 48 are preferably preheated by the preheating assembly 56 to a temperature of about 85° C. for the described toner, so that the sides immediately attain a temperature in the transfuse nip 50 which allows the toner 62 to flow or wick into the textured surface even as the toner itself undergoes a drop in temperature due to contacting the substrate 48. In general, the surface energy of the substrate 48 is above 40 dynes/cm, and the toner image is released from the first transfer member 14 to the substrate as the substrate 48 moves through the transfuse nip 50.

The calibration stations 17 and 37 can temporarily suspend the printing process by opening the transfuse nip 50. A calibration image may then be formed on the imaging members 10 and 30 and transferred to the transfer members 14 and 34 at the nips 12 and 32. The calibration image is then transferred to a dedicated calibration web by closing the nips 12 and 32. The calibration stations 17 and 37 scan the calibration images and collect calibration data to calibrate the print heads within the imaging centers 18 and 38.

Figure 4:
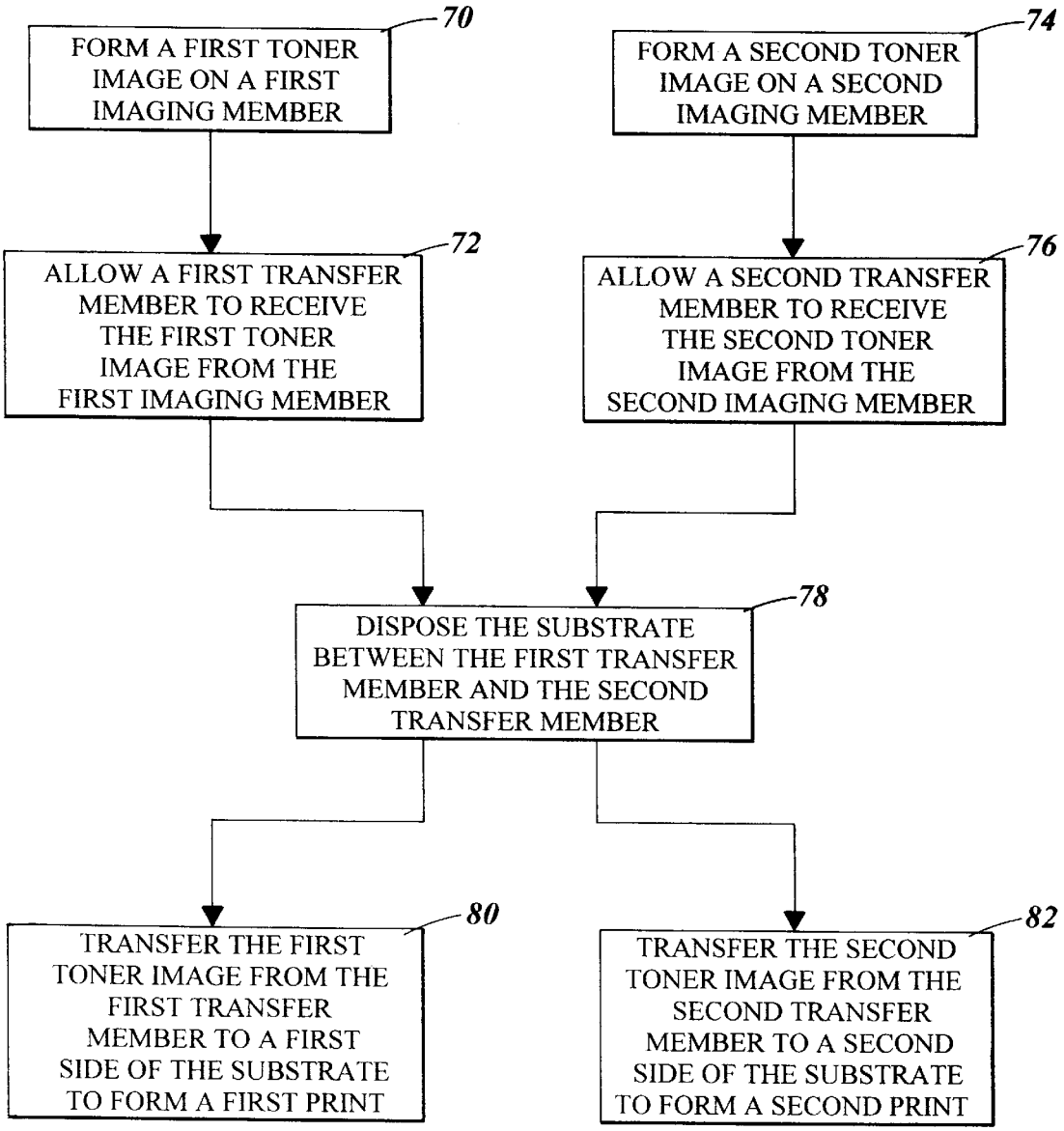
FIG. 4 shows a flow chart indicating steps for printing on both sides of a substrate.

Referring to FIG. 4, a flow chart is presented indicating steps for printing on both sides of a substrate 48. In step 70, a first toner image is formed on the first imaging member 10, and the image is then transferred to a first transfer member 14 (step 72). A second toner image is formed on the second imaging member 30 (step 74), and is then transferred to a second transfer member 34 (step 76). In step 78, the substrate 48 is disposed between the first transfer member 14 and the second transfer member 34, and the first toner image is transferred from the first transfer member 14 to a first side of the substrate 48 to form a first print (step 80). Subsequently, in step 82, the second toner image is transferred from the second transfer member 34 to a second side of the substrate 48 to form a second print, wherein, in one embodiment, the first print and the second print are formed simultaneously. In a different embodiment, the first and second print are not formed simultaneously. Instead, it is possible for some time to elapse between the formation of the first print and the second print at the transfuse nip 50, thereby staggering the first and second prints on the substrate 48.

Figure 5:
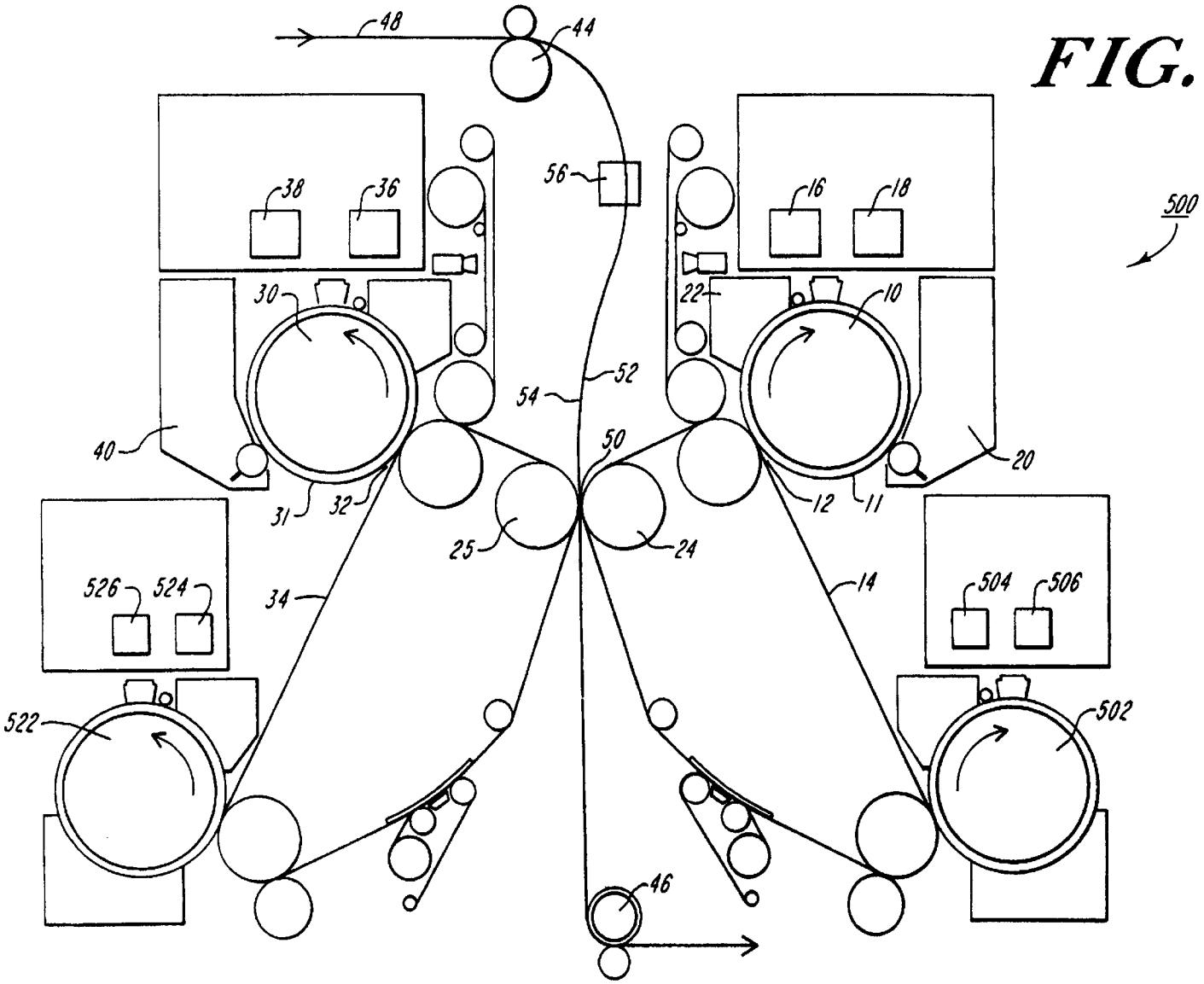
FIG. 5 is a schematic representation of an image forming system for performing multi-color duplex printing on a substrate according to the teachings of the present invention.

Referring to FIG. 5, an image forming system 500 having an expanded architecture that enables the addition of a different color (i.e., highlight color) to the first side 52 and the second side 54 of the substrate 48 is presented. Many of the components of the image forming system 500 are the same as the components of the system 100 described above, with like reference numerals referring to like parts. The image forming system 500 includes an auxiliary first imaging member 502 and an auxiliary second member 522. The illustrated image forming system 500 further includes an auxiliary first erase station 504 and first imaging center 506 and an auxiliary second erase station 524 and second imaging center 526.

The first and second auxiliary erase stations 504 and 524 produce positive and negative ions, which electrically neutralize the charge on the image receptor to a desired uniform potential. The first and second imaging centers 506 and 526 each include a print head having an array of electron guns for projecting pixels of image charge of the desired dot density (i.e. 600 dpi) onto the surfaces of the imaging members 502 and 522. These imaging members 502 and 522 can add an extra layer of toner to the substrate 48. The advantage of the added architecture in system 500 is that, with the addition of the extra layer of toner, highlight color can be added to the images formed on the substrate 48. Similar to system 100 of FIG. 1, the system 500 is arranged to apply images to both sides of a substrate 48 at a single nip, the transfuse nip 50.

Those skilled in the art will recognize, or be able to ascertain using no more than routine experimentation, many equivalents to the specific embodiments and methods described herein. Such equivalents are intended to be encompassed by the scope of the following claims.

What is claimed:

1. An image forming system for printing on both sides of a substrate comprising:

first and second transfer members moving in a continuous path at a first velocity, the first and second transfer members forming a single transfuse nip therebetween;

a first imaging member for generating a first toner image with toner that is received by the first transfer member;

a second imaging member for generating a second toner image with toner that is received by the second transfer member; and, means for driving the substrate through the single transfuse nip at a second velocity, the second velocity being higher than the first velocity, thereby creating a shear force for lifting the first toner image and second toner image from the first and second imaging members.

2. The system of claim 1, wherein, at the single transfuse nip, the first transfer member exerts a first force on the substrate to form a first print, and the second transfer member exerts a second force on the substrate to form a second print, such that the first force and the second force simultaneously oppose each other.

3. The system of claim 1, wherein a first print and a second print are formed simultaneously on the substrate at the single transfuse nip.

4. The system of claim 1, wherein the first and second transfer members each have a surface energy of between about 20 and about 40 dynes/cm, and a hardness of between about 50 and about 80 Shore A.

5. The system of claim 1, wherein the toner has a softening temperature $T_s$, and wherein the first imaging member and the first transfer member each operate substantially isothermally at temperatures T1 and T2, respectively, and wherein the second imaging member and the second transfer member each operate substantially isothermally at temperatures T1 and T2, respectively, such that $T1<T_s<T2$.

6. The system of claim 5, wherein the first transfer member transfers the first toner image in a melted state to a first side of the substrate, and the second transfer member transfers the second toner image in a melted state to a second side of the substrate, as the temperature of the first toner image and the second toner image decrease.

7. The system of claim 6, further comprising a preheat assembly for preheating the substrate to a temperature T3 prior to introduction to the single transfuse nip, such that $T3<T2$.

8. A printing system for duplex printing comprising a first imaging member for forming a first toner image;

a first transfer member for receiving the first toner image from the first imaging member and transferring said first toner image to a first side of a substrate to form a first print;

a second imaging member for forming a second toner image; and second transfer member for receiving the second toner image from the second imaging member and transferring said second toner image to a second side of the substrate to form a second print; and, a transfuse nip formed at an interface between the first and second transfer members, whereby the first and second transfer members undergo distortion creep caused by externally applied forces urging the first and second transfer members against each other.

9. An image forming system comprising:

a first print engine for forming a first toner image;

a second print engine for forming a second toner image; and a single transfuse nip formed between the first and second print engines wherein the first and second toner images are transferred to opposite sides of a substrate at the nip by a combination of differential surface energies between the substrate and the first and second print engines, differential temperatures between the substrate and the first and second print engines, and differential speeds between the first and second print engines.

10. A method of printing an image on both sides of a substrate in an image forming system, the method comprising the steps of forming a first toner image with a first print engine;

transferring the first toner image to a transfuse nip;

forming a second toner image with a second print engine;

transferring the second toner image to the transfuse nip; and transferring the first toner image to a first side of the substrate, and transferring the second toner image to a second side of the substrate at the transfuse nip by a combination of differential surface energies between the substrate and the first and second print engines, and differential temperatures between the substrate and the first and second print engines.

11. The method of claim 10, further comprising the step of exerting a first force on a first transfer member carrying the first toner image, and exerting a second force on a second transfer member carrying the second toner image when the first and second toner images are transferred to the substrate at the transfuse nip.

12. The method of claim 11, wherein, in the step of exerting, the first and second transfer members each have a surface energy of between about 20 and about 40 dynes/cm and a hardness of between about 50 and 80 Shore A.

13. An image forming system for printing on both sides of a substrate comprising:

first and second transfer members forming a single transfuse nip therebetween;

a first imaging member for generating a first toner image that is received by the first transfer member; and a second imaging member for generating a second toner image that is received by the second transfer member;

wherein, at the single transfuse nip, the first transfer member exerts a first force on the substrate to form a first print, and the second transfer member exerts a second force on the substrate to form a second print, such that the first force and the second force simultaneously oppose each other.

14. The system of claim 13, wherein the first print and the second print are formed simultaneously on the substrate at the single transfuse nip.

15. An image forming system for printing on both sides of a substrate comprising:

first and second transfer members forming a single transfuse nip therebetween;

a first imaging member for generating a first toner image that is received by the first transfer member; and a second imaging member for generating a second toner image that is received by the second transfer member;

wherein the first and second transfer members each have a surface energy of between about 20 and about 40 dynes/cm, and a hardness of between about 50 and about 80 Shore A, and wherein at the single transfuse nip, the first transfer member is suitable for transferring said first toner image to a first side of the substrate to form a first print, and the second transfer member is suitable for transferring said second toner image to a second side of the substrate to form a second print.

16. An image forming system for printing on both sides of a substrate comprising:

first and second transfer members forming a single transfuse nip therebetween;

a first imaging member for generating a first toner image with toner that is received by the first transfer member; and a second imaging member for generating a second toner image with toner that is received by the second transfer member;

wherein the toner has a softening temperature $T_s$, and wherein the first imaging member and the first transfer member each operate substantially isothermally at temperatures T1 and T2, respectively, and wherein the second imaging member and the second transfer member each operate substantially isothermally at temperatures T1 and T2, respectively, such that $T1<T_s<T2$ and wherein, at the single transfuse nip, the first transfer member is suitable for transferring said first toner image to a first side of the substrate to form a first print, and the second transfer member is suitable for transferring said second toner image to a second side of the substrate to form a second print.

17. The system of claim 16, wherein the first transfer member transfers the first toner image in a melted state to the first side of the substrate, and the second transfer member transfers the second toner image in a melted state to the second side of the substrate, as the temperature of the first toner image and the second toner image decrease.

18. The system of claim 17, further comprising a preheat assembly for preheating the substrate to a temperature T3 prior to introduction to the single transfuse nip, such that $T3<T2$.

19. A method of printing an image on both sides of a substrate in an image forming system, the method comprising the steps of forming a first toner image;

transferring the first toner image to a transfuse nip;

forming a second toner image;

transferring the second toner image to the transfuse nip;

transferring the first toner image to a first side of the substrate, and transferring the second toner image to a second side of the substrate at the transfuse nip; and, exerting a first force on a first transfer member carrying the first toner image, and exerting a second force on a second transfer member carrying the second toner image when the first and second toner images are transferred to the substrate at the transfuse nip, wherein, the first and second transfer members each have a surface energy of between about 20 and about 40 dynes/cm and a hardness of between about 50 and 80 Shore A.

* * * * *